US009411277B1

(12) United States Patent
Takada

(10) Patent No.: US 9,411,277 B1
(45) Date of Patent: Aug. 9, 2016

(54) FIXING DEVICE AND IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventor: Setsuo Takada, Izunokuni Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,813

(22) Filed: May 20, 2015

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2007/0047983 A1* 3/2007 Itoh ..... G03G 15/2039 399/33
2009/0169232 A1* 7/2009 Kunii ..... G03G 15/5004 399/70

* cited by examiner

*Primary Examiner* — Sandra Brase
(74) *Attorney, Agent, or Firm* — Patterson & Sheridan, LLP

(57) ABSTRACT

A fixing device includes a fixing unit configured to fix an image on a sheet with heat when the sheet passes through a nip formed in the fixing unit, a temperature detection unit disposed adjacent to the fixing unit, and a control unit configured to change a maximum amount of power that is suppliable to the fixing unit from a first value to a second value that is smaller than the first value, based on a temperature detected by the temperature detection unit.

17 Claims, 8 Drawing Sheets

FIXING DEVICE AND IMAGE FORMING APPARATUS HAVING THE SAME

FIELD

Embodiments described herein relate generally to a fixing device and an image forming apparatus having the same.

BACKGROUND

A fixing device fixes an image (toner image) formed on a sheet with heat when the sheet passes through the fixing device. One type of the fixing device detects a temperature of the fixing device (e.g., fixing belt or heating roller) and, based on the detected temperature, controls a temperature of a heating region to be within a target temperature range that is preferable to fix the image. One way of controlling the temperature would be turning on and off a heating unit of the fixing device. However, controlling the temperature only by turning on and off the heating unit would be difficult. It would be desirable to control the temperature to be within the target temperature range in an easier manner.

DETAILED DESCRIPTION

In general, according to one embodiment, a fixing device includes a fixing unit configured to fix an image on a sheet with heat when the sheet passes through a nip formed in the fixing unit, a temperature detection unit disposed adjacent to the fixing unit, and a control unit configured to change a maximum amount of power that is suppliable to the fixing unit from a first value to a second value that is smaller than the first value, based on a temperature detected by the temperature detection unit.

Figure 1:
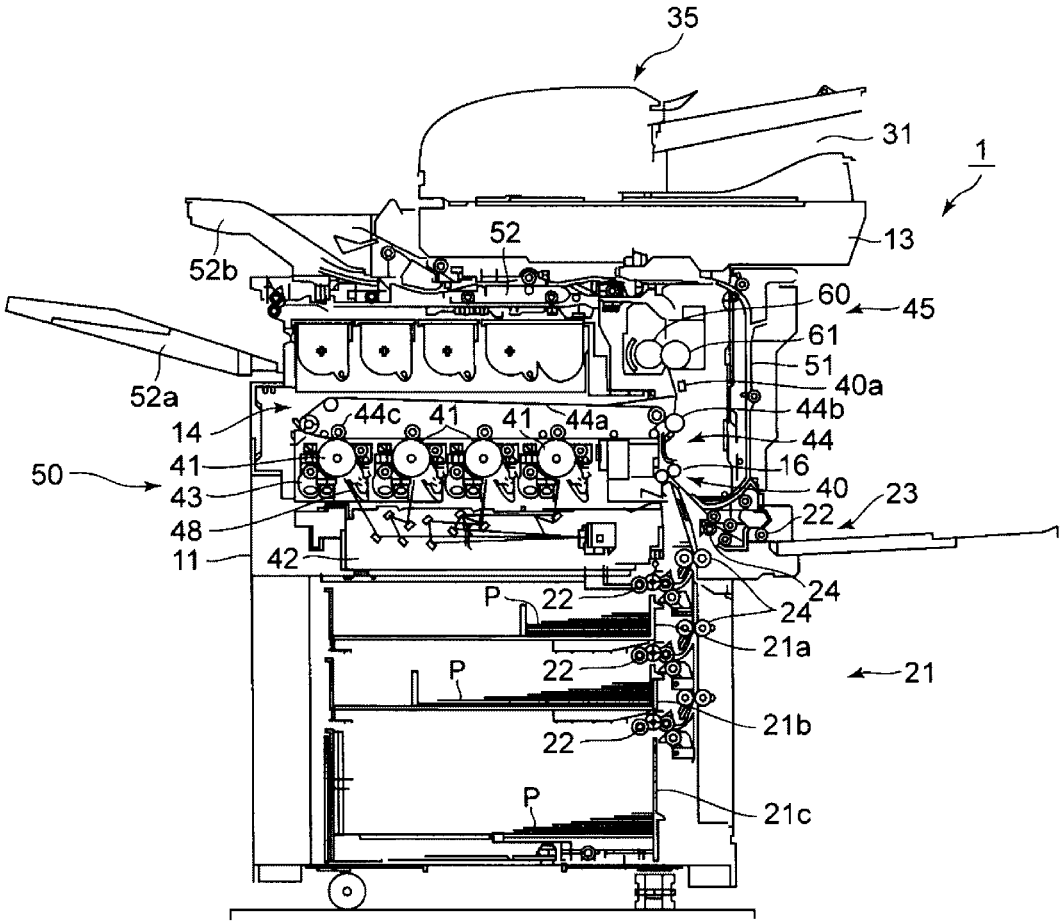
FIG. 1 illustrates an MFP having a fixing device according to one embodiment.

Hereinafter, a fixing device according to the embodiment will be described. FIG. 1 illustrates a Multi Functional Peripheral (hereinafter, "MFP") 1 which is an image forming apparatus having the fixing device. The MFP 1 includes a scanner unit 13 which reads an image, a printer unit 14 which is an image forming unit, a sheet feeding unit 21 which feeds a sheet P which is a recording medium, and a sheet discharging unit 52 which includes first and second trays 52*a* and 52*b* which store the sheet P discharged from the printer unit 14. The MFP 1 includes a manual sheet feeding unit 23 at a side portion of a housing 11. The MFP 1 includes a transport mechanism 40 of the sheet P along a sheet conveyance path along which the sheet is conveyed from the sheet feeding unit 21 or the manual sheet feeding unit 23 to the sheet discharging unit 52 through the printer unit 14.

The scanner unit 13 generates image information after scanning the original document which is supplied from an automatic document feeder (AFD) 35. When the image information is generated using the scanner unit 13, the ADF 35 discharges the original document to an original document discharging unit 31.

The printer unit 14 forms on the sheet P an image corresponding to image information input from an external device or the image information generated by the scanner unit 13. The printer unit 14 includes an exposure device 42 and a transfer unit 44, in addition to four sets of image forming stations 50 of yellow (Y), magenta (M), cyan (C), and black (K). The transfer unit 44 transfers a toner image which is formed on the sheet P, which has an arbitrary size, in the image forming station 50 on a sheet P. The printer unit 14 includes a fixing device 45 which fixes the toner image on the sheet P.

The four sets of image forming stations 50 have the same structure, and include a photosensitive drum 41, a charging device 48, and a developing device 43. The charging device 48 uniformly charges the surface of the photosensitive drum 41 which is an image carrier. The developing device 43 supplies toner such that an electrostatic latent image which is formed on the surface of the photosensitive drum 41 is developed as a toner image after the surface is irradiated with exposure light using the exposure device 42 while the photosensitive drum 41 is charged.

The transfer unit 44 includes an intermediate transfer belt 44*a*, a primary transfer roller 44*c*, and a secondary transfer roller 44*b*. The sheet feeding unit 21 includes an upper sheet feeding cassette 21*a*, a lower sheet feeding cassette 21*b*, and a large cassette 21*c*.

The transport mechanism 40 includes a transport roller 24 and a resist roller 16. The transport roller 24 supplies a sheet P which is taken out from the sheet feeding unit 21 or the manual sheet feeding unit 23 using a pickup roller 22 to the transfer unit 44. The transport mechanism 40 transports the sheet P including a fixed toner image which is formed while passing through the transfer unit 44 and the fixing device 45, to the sheet discharging unit 52 or a circulation path 51.

The sheet discharging unit 52 discharges the sheet P to the first tray 52*a* or the second tray 52*b*, or reverses the sheet P in a direction towards the circulation path 51. The circulation path 51 guides the sheet P to the transfer unit 44 again. In addition, the transport mechanism 40 includes a sheet sensor 40*a* which detects the sheet P while the sheet P reaches the fixing device 45 from the transfer unit 44.

The sheet P which is supplied from any one of the sheet feeding unit 21 and the manual sheet feeding unit 23 passes through the transport mechanism 40, and reaches a nip between the intermediate transfer belt 44*a* and the secondary transfer roller 44*b* in synchronization with conveyance of the toner image which is primarily transferred onto the intermediate transfer belt 44*a*. The secondary transfer roller 44*b* performs secondary transfer of the toner image on the intermediate transfer belt 44*a* to the sheet P passing through the nip between the intermediate transfer belt 44*a* and the secondary transfer roller 44*b*. The fixing device 45 fixes the toner image on the sheet P.

The sheet discharging unit 52 discharges the sheet P with the fixed toner image to the first tray 52*a* or the second tray 52*b*. The circulation path 51 guides the sheet P after the toner image is fixed thereon, in a direction of the secondary transfer roller 44*b* of the transfer unit 44 again.

Figure 2:
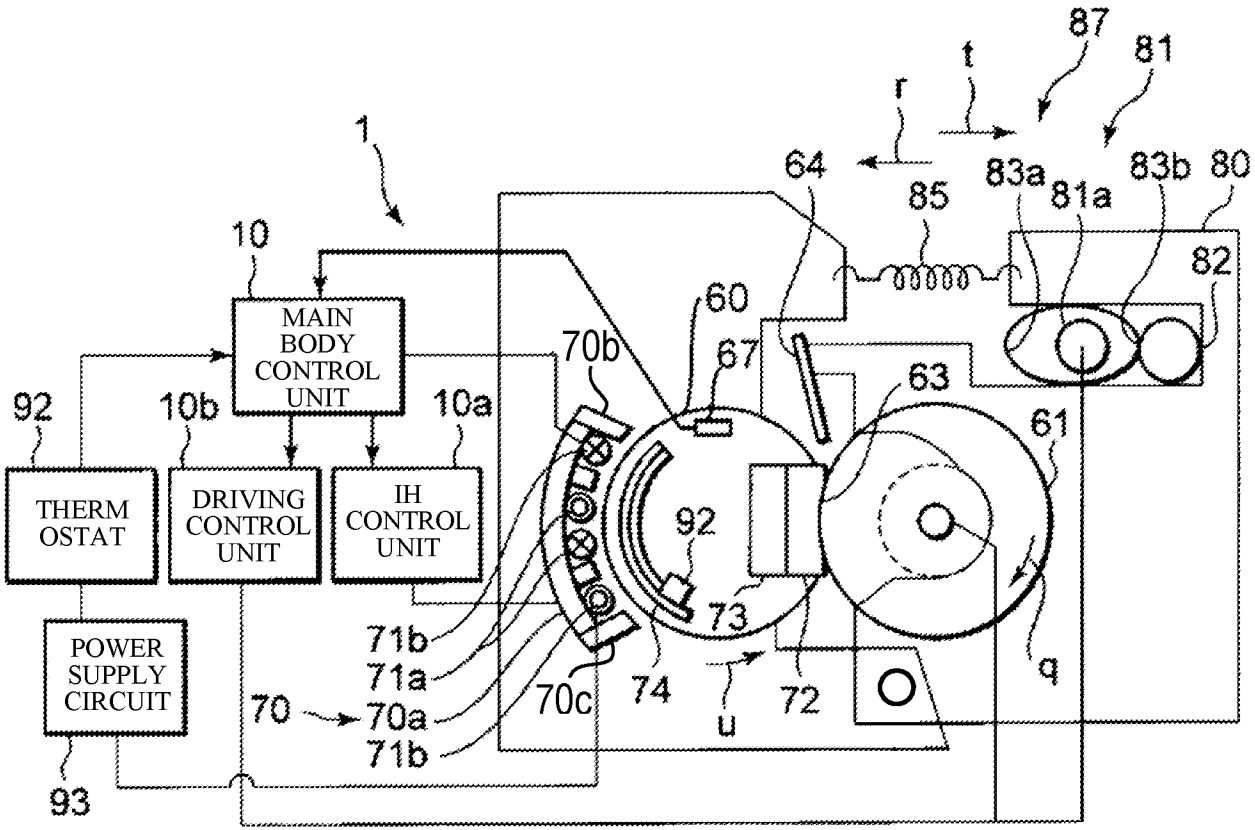
FIG. 2 illustrate the fixing device.
Figure 3:
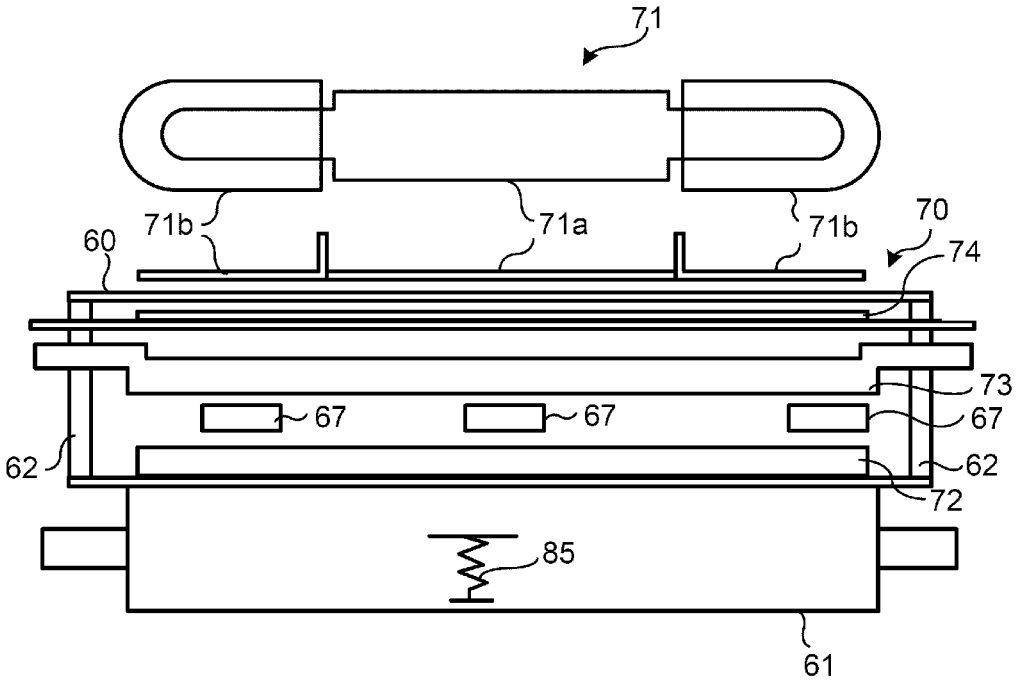
FIG. 3 illustrates a temperature detection portion of a fixing belt in the fixing device.

Subsequently, the fixing device 45 will be described in detail. FIG. 2 illustrates the fixing device 45. In addition, FIG. 3 illustrates a temperature detection portion of a fixing belt 60 in the fixing device 45. As illustrated in FIGS. 2 and 3, the fixing device 45 includes the fixing belt 60, a press roller 61, an induced current generation coil (hereinafter, referred to as "IH coil") 70, a fixing pad 72 which is a nip forming member, an auxiliary heat generating member 74, and a contact-type thermistor 67. The fixing device 45 includes a separation blade 64, which is a separation member, on the outer periphery of the fixing belt 60 on the discharging side of the sheet P with respect to a nip 63.

The fixing belt 60 is in an endless shape and has a multi-layered structure. The fixing belt 60 includes, for example, a metallic heat generating layer formed of nickel (Ni) with a thickness of 40 μm, an adhesive layer with a thickness of 20 μm, a silicone rubber layer with a thickness of 200 μm, and a mold release layer formed of fluororesin with a thickness of 30 μm at a periphery of a support layer. As a material of the metallic heat generating layer, stainless steel, copper (CU), silver (Ag), a compound material of iron and nickel (Ni), or the like, may be used. A flange 62 supports both sides of the fixing belt 60. The fixing belt 60 rotates following the press roller 61 integrally with the flange 62, or independently rotates.

The fixing pad 72 is formed of silicon sponge or silicon rubber having a heat-resisting property, for example. The fixing pad 72 includes a mold release layer which is formed of fluororesin, for example, on the surface. A stay 73 supports the fixing pad 72, and fixes the fixing pad 72 into the fixing belt 60.

The press roller 61 is a pressurizing member which includes a heat-resistant silicon sponge or a silicon rubber layer at the periphery of a core metal, for example, and includes a mold separation layer of PFA on the surface thereof. The press roller 61 is connected to a pressurizing changing mechanism 87 which adjusts a pressurizing force of the press roller 61 with respect to the fixing pad 72. The pressurizing changing mechanism 87 includes a cam 81, a bearing 82, and a pressurizing spring 85. The pressurizing spring 85 pressurizes the press roller 61 in a direction of the arrow r.

When the fixing device 45 is used, a cam face 83*b* of the elliptic cam 81 which is close to a rotation center 81*a* comes into contact with the bearing 82, and pressurizes the press roller 61 toward the fixing pad 72 with a pressure in a direction of the arrow r using the pressurizing spring 85. While the fixing device 45 is not used, a cam face 83*a* of the cam 81 which is far from the rotation center 81*a* comes into contact with the bearing 82. A press roller frame 80 rotates in a direction of the arrow t, a pressure to the fixing pad 72 of the press roller 61 decreases, and an occurrence of a permanent strain in the press roller 61 is prevented.

The press roller frame 80 fixes and supports the separation blade 64. While the fixing device 45 is used, the separation blade 64 faces the fixing belt 60 along the fixing pad 72. While the fixing device 45 is not used, if a pressure with respect to the fixing pad 72 of the press roller 61 decreases, the shape of the fixing pad 72 that is shrunk with the pressure is restored. When the shape of the fixing pad 72 is restored, the press roller 61 is separated from the fixing pad 72. When performing separation of the sheet P, it is possible for the separation blade 64 to cause a tip end of the separation blade 64 to be closer to the fixing belt 60 in order to reliably separate the sheet P. When performing separation, it is possible to maintain a gap between the tip end of the separation blade 64 and the fixing belt 60 in a range of 0.1 mm to 0.4 mm, for example.

The IH coil 70 includes a magnetic core 70*a* and a coil 71. The magnetic core 70*a* includes an upstream core 70*b* at an end portion on the upstream side, and a downstream core 70*c* at an end portion on the downstream side along a rotational direction of the fixing belt 60 in a direction of the arrow u. The magnetic core 70*a* intensifies a magnetic field using the coil 71. A magnetic flux generation region (heating region) of the IH coil 70 generated due to excitation in the rotational direction of the fixing belt 60 is determined in accordance with positions of the upstream core 70*b* and the downstream core 70*c*. Specifically, in the magnetic flux generation region of the IH coil 70, a magnetic flux generation upstream end portion is determined based on the position of the upstream core 70*b*, and a magnetic flux generation downstream end portion is determined based on the position of the downstream core 70*c*.

The coil 71 includes a first coil 71*a* and a second coil 71*b*. The first coil 71*a* generates a magnetic flux in whole length of the fixing belt 60 in the longitudinal direction. A current direction of the second coil 71*b* is opposite to a current direction of the first coil 71*a* in both sides of the fixing belt 60 in the longitudinal direction, and the magnetic flux of the second coil 71*b* cancels the magnetic flux of the first coil 71*a*. As a material of the coil 71, a litz wire which is formed by bundling one hundred of copper wire rods with a line diameter of 0.2 mm covered with heat resistant polyamide imide as an insulation material can be used.

An eddy current is generated in the metallic heat generating layer of the fixing belt 60 by applying a high frequency current to the first coil 71*a*, and by generating a magnetic flux. Joule heat is generated due to the eddy current and a resistance value of the metallic heat generating layer, and the surface of the fixing belt 60 in the whole length in the longitudinal direction is heated. Using heat generated by exciting the first coil 71*a*, a toner image is fixed onto the sheet P with a width of an A4 vertical size (297 mm) of the JIS standard, for example.

When the first coil 71*a* and the second coil 71*b* are excited, the second coil 71*b* cancels excitation of the first coil 71*a*. When the first coil 71*a* and the second coil 71*b* are excited, the sheet P with a width of an A4 horizontal size (210 mm) of the JIS standard is fixed, for example.

The auxiliary heat generating member 74 is provided so as to face a magnetic flux generation region of the IH coil 70 in the fixing belt 60, and generates heat due to a magnetic flux which penetrates the fixing belt 60. The auxiliary heat generating member 74 is fixed with a gap of approximately 1 mm, for example, from the inner periphery of the fixing belt 60. The auxiliary heat generating member 74 includes, for example, a mold release layer which is formed of fluororesin with a thickness of 15 μm, a metallic heat generating layer with a thickness of 0.2 mm, a soaking layer which is formed of aluminum with a thickness of 0.5 mm, and a protecting layer which is formed of a white PFA resin with a thickness of 10 μm from the inner peripheral face side of the fixing belt 60 in order. The auxiliary heat generating member 74 prevents a temperature of the fixing belt 60 from falling by warming the fixing belt 60 from an inner peripheral side thereof.

In addition, as the metallic heat generating layer of the auxiliary heat generating member 74, for example, magnetic shunt metal of which Curie point is 230° C. may be used in order to prevent an abnormal heat generation. The thermistor 67 is provided inside and in contact with the fixing belt 60, detects a temperature of the fixing belt 60 as a voltage value, and inputs a detection result thereof to a main body control unit 10.

The main body control unit 10 controls a thermostat 92, an IH control unit 10*a*, and a driving control unit 10*b*. The IH control unit 10*a* controls supply of a high frequency current to the IH coil 70. The driving control unit 10*b* controls a pressure adjustment and rotation driving of the press roller 61. The thermostat 92 interrupts a power supply to the IH coil 70 from a power supply circuit 93, and prevents abnormal heat generation of the fixing device 45 when abnormal heat generation of the fixing device 45 is detected thorough the main body control unit 10.

The IH control unit 10*a* excites the coil 71 according to a size of the sheet P. The IH control unit 10*a* performs a feedback control of the IH coil 70 based on a detection result of the thermistor 67, and maintains a temperature of the fixing belt 60 in a target temperature range. The magnetic flux of the coil 71 generates an eddy current in the metallic heat generating layer of the fixing belt 60, and heats the fixing belt 60.

When a change in belt temperature in time sequence which is detected by the thermistor 67 satisfies a predetermined temperature change pattern, which serves as an index for determining a state in the device, the IH control unit 10*a* switches a setting upper limit of power supplied to the IH coil 70 from a first upper limit corresponding to a maximum power value which is allocated to the fixing device 45 in advance to a second upper limit which is lower than the first upper limit. The temperature change pattern may be arbitrarily defined. According to the embodiment, it is determined that a change in the detected temperature satisfies the temperature change pattern when one cycle which is formed of an ascending curve and a descending curve within the target temperature range is completed, after the supplied power is changed between the first upper limit and the lower limit.

Figure 4:
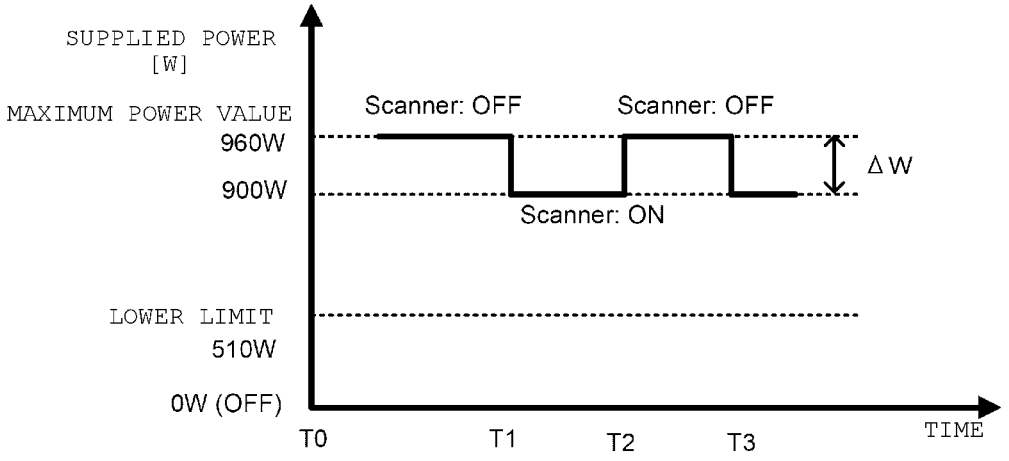
FIG. 4 illustrate switching a maximum value of power that can be allocated to the fixing device.

FIG. 4 illustrates switching of the maximum value (first upper limit) of power that can be allocated to the fixing device 45 of the MFP 1. As illustrated in FIG. 1, the fixing device 45 is a part of the MFP 1; however, a maximum amount of power which may be supplied to the entire MFP 1 is fixed. When a commercial power supply is used, it is 100 V/15 A in Japan. Accordingly, a maximum value of power which may be used in each of the fixing device 45, an image forming portion, and an optional device (supplement) is predetermined such that the total value of power used by the entire MFP 1 is 15 A or less. According to the embodiment, the main body control unit 10 performs distribution of power to each unit, and the IH control unit 10*a* controls an amount of power supplied to the IH coil 70.

The main body control unit 10 instantly determines whether or not an optional device such as a scanner is connected to the MFP 1 when the MFP 1 is turned on. When an optional device is not connected, the main body control unit 10 may cause the fixing device 45 to use power for the optional device.

Further, it is possible to switch a maximum power value which the fixing device 45 may use according to an operation state (ON or OFF) of the optional device. As illustrated in FIG. 4, at a time of non-operation of a scanner (T0 to T1 and T2 to T3), since power Δ W which is allocated to the scanner may be used by the fixing device 45, the maximum power value of the fixing device 45 is 960 W. At an operation time of the scanner (T1 to T2), the maximum power value of the fixing device 45 is 900 W which is lower than 960 W by Δ W.

In addition, when the value of power supplied to the fixing device 45 is instantly lowered to 0 W from the maximum value, since the thickness of a base material of the fixing belt 60 is small and a heat capacity is small, a temperature of the fixing device 45 rapidly falls and a fixing failure may occur. Therefore, in FIG. 4, in order to prevent a rapid temperature fall of the fixing device 45, a lower limit of 510 W is set, in addition to two types of maximum values (first and second upper limits). It is preferable to set the lower limit to be a half or more of the first upper limit.

Figure 5:
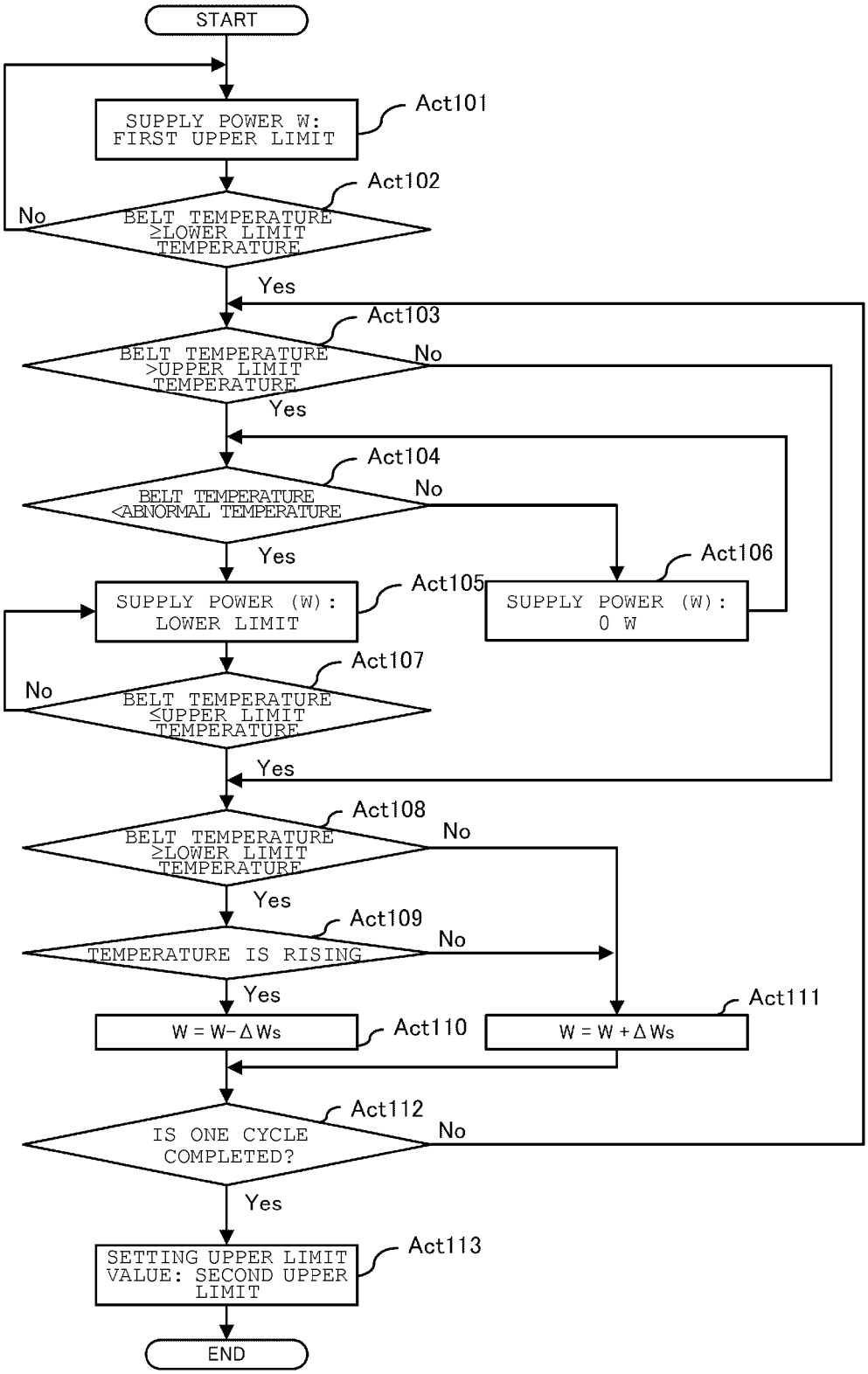
FIG. 5 is a flowchart of a power supply control carried out by an IH control unit.

Subsequently, operations of the MFP 1 will be described based on drawings. FIG. 5 is a flowchart of a power control process of the IH control unit 10*a*. The process is started when a printing job is received. Here, for ease of descriptions, there is no change in the first upper limit in accordance with connection or disconnection of the optional device, as illustrated in FIG. 4.

When the MFP 1 is turned on or a stand-by time is terminated, a temperature of the fixing device 45 is low. The IH control unit 10*a* controls the supply power W having the first upper limit to the IH coil 70, and starts heating the fixing device 45 (Act 101).

Subsequently, the IH control unit 10*a* obtains a temperature of the fixing belt 60 (hereinafter, "belt temperature") detected by the thermistor 67, and determines whether or not the belt temperature is equal to or higher than a lower limit temperature of the target temperature range (Act 102). Here, when it is determined that the belt temperature is equal to or higher than the lower limit temperature (Yes in Act 102), the process proceeds to Act 103. When it is determined that the belt temperature is lower than the lower limit temperature (No in Act 102), the process returns to Act 101. That is, the IH control unit 10*a* continues heating with the power of the first upper limit (maximum power) until the belt temperature reaches the lower limit temperature.

In Act 103, the IH control unit 10*a* determines whether or not the belt temperature exceeds the upper limit temperature of the target temperature range. Here, when it is determined that the belt temperature exceeds the upper limit temperature (Yes in Act 103), the process proceeds to Act 104. When it is determined that the belt temperature is equal to or lower than the upper limit temperature (No in Act 103), the process proceeds to Act 108.

In Act 104, the IH control unit 10*a* determines whether or not the belt temperature is lower than a predetermined abnormal temperature. Here, when it is determined that the belt temperature is lower than the abnormal temperature (Yes in Act 104), the process proceeds to Act 105. When it is determined that the belt temperature is equal to or higher than the abnormal temperature (No in Act 104), the value of the supplied power W is set to 0 W in order to lower the belt temperature (Act 106), and the process returns to Act 104.

In Act 105, the IH control unit 10*a* controls the value of the power W supplied to the IH coil 70 so as to be the lower limit in order to lower the belt temperature down to the target temperature range, and the process proceeds to Act 107.

In Act 107, the IH control unit 10*a* determines whether or not the belt temperature is equal to or lower than the upper limit temperature of the target temperature range. Here, when it is determined that the belt temperature is equal to or lower than the upper limit temperature, that is, the belt temperature is in the target temperature range (Yes in Act 107), the process proceeds to Act 108. When it is determined that the belt temperature exceeds the upper limit temperature (No in Act 107), the process returns to Act 105.

In Act 108, the IH control unit 10*a* determines whether or not the belt temperature is equal to or higher than the lower limit temperature. Here, when it is determined that the belt temperature is equal to or higher than the lower limit temperature (Yes in Act 108), the process proceeds to Act 109. When it is determined that the belt temperature is lower than the lower limit temperature (No in Act 108), the process proceeds to Act 111.

In Act 109, the IH control unit 10*a* determines whether or not the belt temperature is rising. Here, when it is determined that the belt temperature is rising (Yes in Act 109), since the currently supplied power W is excessive, the power W is lowered by a predetermined variable width Δ W (Act 110), and the process proceeds to Act 112. In contrast, when it is determined that the belt temperature is falling (No in Act 109), the process proceeds to Act 111.

In Act 111, in the IH control unit 10*a*, since the currently supplied power W is insufficient, the power W is increased by the variable width Δ W, and the process proceeds to Act 112.

In Act 112, the IH control unit 10*a* determines whether or not predetermined one cycle of temperature change in the target temperature range is completed, and when it is determined that one cycle is completed (Yes in Act 112), the process proceeds to Act 113. When it is determined that the one cycle is not completed (No in Act 112), the process returns to Act 103.

In Act 113, the IH control unit 10*a* switches the setting upper limit value of the power W supplied to the IH coil 70 to the second upper limit which is lower than the first upper limit (initial value), and ends the process. Switching of the setting upper limit value means that the fixing device 45 is sufficiently warmed.

Figure 6:
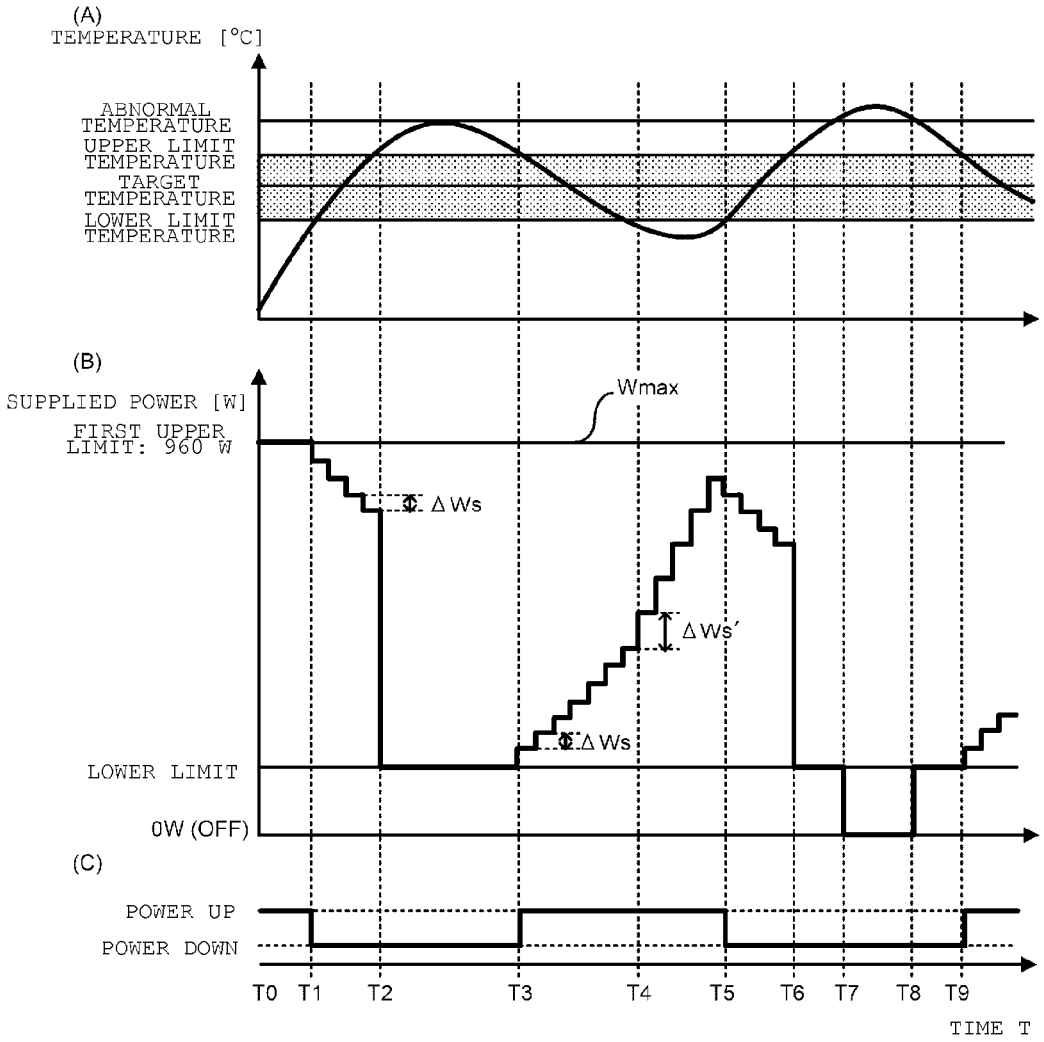
FIGS. 6 and 7 each illustrate a relationship between a detected temperature of the fixing belt and a value of supplied power in time sequence.

FIG. 6 is a diagram which describes a relationship between a detected temperature of the fixing belt 60 and a power control in time sequence. The top column (A) illustrates a relationship between a detected temperature of the fixing belt 60 and a time. The middle column (B) illustrates a relationship between the power supplied to the IH coil 70 and the time. The lower column (C) illustrates a relationship between an increasing trend (UP) or a decreasing trend (DOWN) of the supplied power illustrated in the middle column (B) and the time. Time axes in (A) to (C) are common.

In a time zone of T0 to T1, power of 960 W, which is the first upper limit, is supplied to the IH coil 70. The belt temperature in time T1 reaches the lower limit temperature of the target temperature range.

In a time zone of T1 to T2, the belt temperature rises within the target temperature range. At this time, the power supplied to the IH coil 70 is controlled so as to decrease by a predetermined step width Δ Ws from 960 W periodically. In T2, when the belt temperature reaches the upper limit temperature of the target temperature range, the supplied power is controlled so as to be lowered to a predetermined lower limit (for example, 510 W).

In a time zone of T2 to T3, the supplied power is maintained to the lower limit. Here, the belt temperature changes between the upper limit temperature and the predetermined abnormal temperature, and in T3, the belt temperature is lowered to the upper limit temperature.

In a time zone of T3 to T4, the belt temperature falls within the target temperature range. At this time, the power supplied to the IH coil 70 is controlled so as to periodically increase from the lower limit by the step width Δ Ws. However, the belt temperature keeps falling, and the belt temperature becomes lower than the lower limit temperature in T4.

In a time zone of T4 to T5, the supplied power is controlled so as to increase by the step width Δ Ws' (>Δ Ws) in a predetermined cycle (for example, 200 ms). As a result, the belt temperature turns to an increasing trend, and in T5, the belt temperature reaches the lower limit temperature.

In time zones of T5 to T6 and T6 to T7, the same control as that in the time zones of T1 to T2 and T2 to T3 is performed.

In a time zone of T7 to T8, the belt temperature becomes the abnormal temperature or more. At this time, the supplied power is maintained at 0 W until T8, and the fixing device 45 is allowed to be cooled. In a time zone of T8 to T9, the same control as that in the time zone of T2 to T3 is performed.

However, between T0 to T9, the fixing device 45 has not stably changed within the target temperature range yet, even though the supplied power is increased or decreased. For this reason, in T9, it is considered that a predetermined temperature changing pattern has not been satisfied yet.

Figure 7:
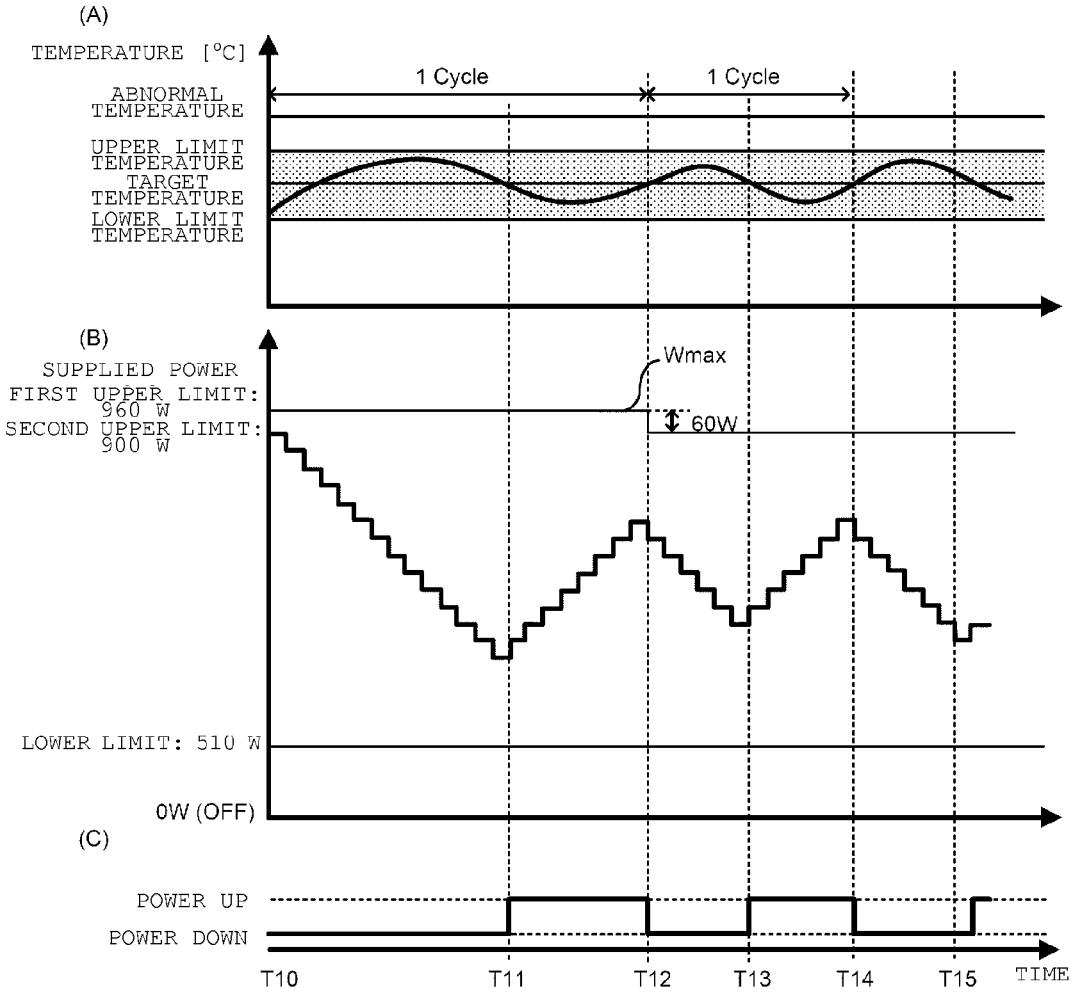

FIG. 7 describes a relationship between a detected temperature of the fixing belt 60 and a power control according to the embodiment. The top column (A) illustrates a relationship between a detected temperature of the fixing belt 60 and a time. The middle column (B) illustrates a relationship between the power supplied to the IH coil 70 and the time. The lower column (C) illustrates a relationship between an increasing trend (UP) or a decreasing trend (DOWN) of the supplied power illustrated in the middle column (B) and the time. Time axes in (A) to (C) are common. FIG. 7 illustrates a state at which it is determined that the fixing device 45 is sufficiently warmed after the temperature control illustrated in FIG. 6 is executed. That is, the first point of time when one cycle of a temperature change is completed within the target temperature range is T12, and a predetermined temperature changing pattern according to the embodiment is satisfied in T12. For this reason, in T12, the setting upper limit $W_{max}$ of the supply power is switched to the second upper limit from the first upper limit. As illustrated in FIG. 7, the second upper limit is 900 W, and is set to a value which is subtracted from the first upper limit 960 W by 60 W. Here, the difference of the setting upper limit is referred to as a first variable width. The first variable width may be arbitrarily defined.

In this manner, according to the embodiment, when the fixing device 45 is sufficiently warmed, and it is possible to maintain a temperature of the fixing device 45 within the target temperature range without supplying the maximum power to the IH coil, the upper limit of the supplied power is switched to the second upper limit which is lower than the maximum power value (first upper limit). Since it is possible to reduce a time period during which a maximum amount of power is supplied, power consumption can also be reduced. That is, it is possible to reduce power consumption using heat which is accumulated in the fixing device 45 or the MFP 1 in which the fixing device 45 is installed.

Modification Example

Hereinafter, some of modification examples of the above described embodiment will be described.

Figure 8:
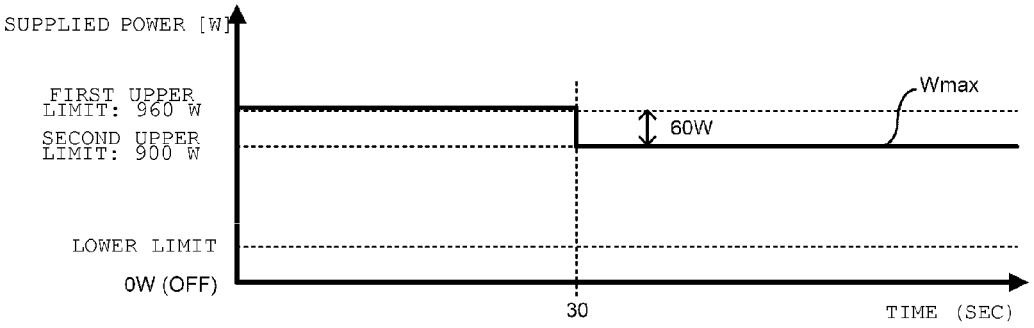
FIG. 8 illustrates a specific example of a power supply control carried out by the IH control unit according to a first modification example of the embodiment.

In the above described embodiment, when the temperature change of the fixing belt 60 satisfies the predetermined temperature changing pattern, the setting upper limit of the supplied power is switched from the first upper limit to the second upper limit. However, it is also possible to switch the setting upper limit when a certain period of time has passes since the startup of the MFP, without referring to the detected temperature. Here, it is assumed that the device is sufficiently warmed after the certain period of time. FIG. 8 illustrates a specific example of a power supply control of the IH control unit in a modification example (1) of the embodiment. Here, the power of a maximum power value (first upper limit) is supplied only for thirty seconds from the startup of the fixing device 45, and then the value of the power is switched to the second upper limit. The switching time may be arbitrarily changed.

In addition, in the above described embodiment, the second upper limit is a constant value. However, when it is determined that the temperature of the device is continuously stable, it is possible to further lower the second upper limit.

Figure 9:
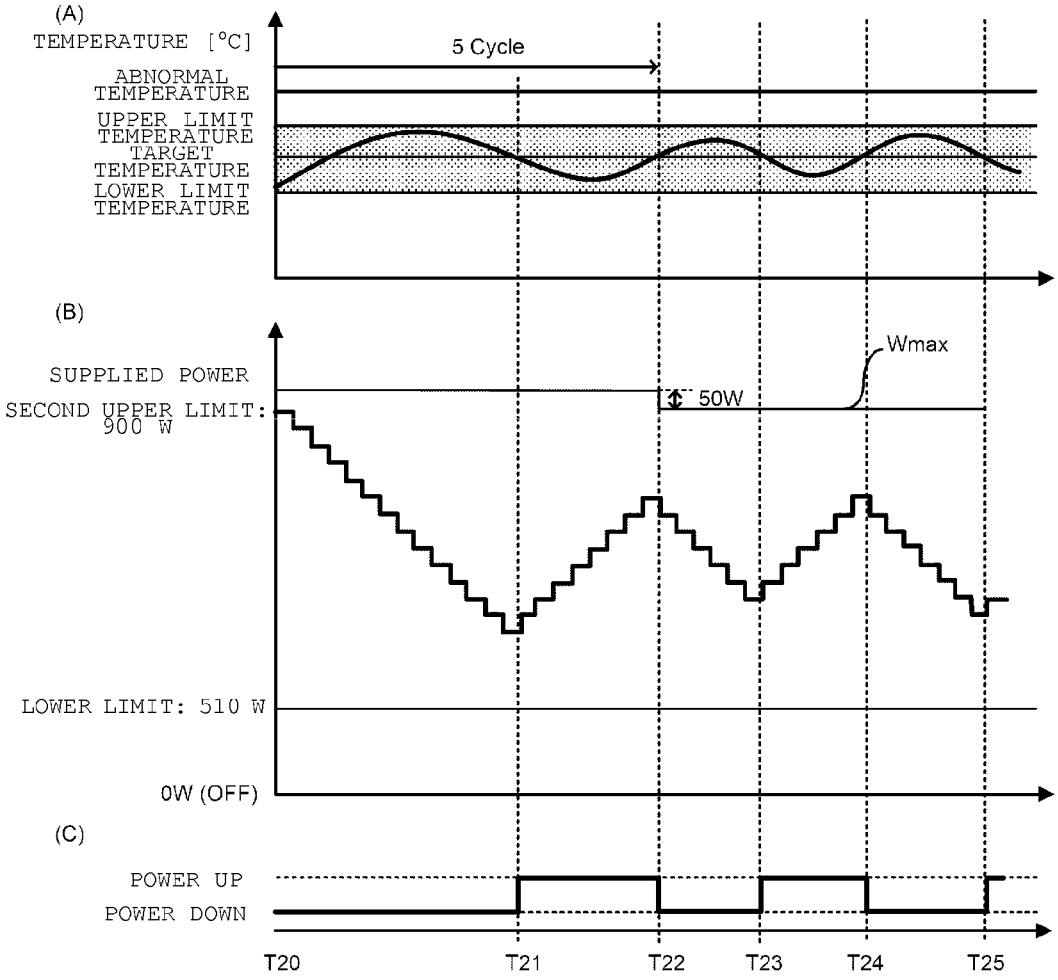
FIG. 9 illustrates a relationship between the detected temperature of the fixing belt and a value of supplied power in time sequence according to a second modification example of the embodiment.

FIG. 9 illustrates a relationship between a detection temperature of the fixing belt 60 and a power control in a modification example (2) of the embodiment. Here, switching of the setting upper limit from the first upper limit to the second upper limit (900 W) is completed in T20. In addition, an ascending curve and a descending curve of the detection temperature of the fixing belt 60 are continued five times within the target temperature range in of T22. At this time, it is possible to determine that the detected temperature is stably within the target temperature range for a sufficiently long time. At T22, the second upper limit is updated from 900 W to 850 W according to this determination. Here, the difference of the second upper limit is referred to as a second variable width. The second variable width may be arbitrarily defined.

In addition, when the ascending curve and the descending curve of five cycles are continued within the target temperature range after lowering the second upper limit, it is possible to further lower the second upper limit by the second variable width. In contrast, when the detected temperature goes out of the target temperature range, the second upper limit may be raised by the second variable width. When the detected temperature does not reach the target temperature range even when the second upper limit is raised, the second upper limit may be further raised by the second variable width. The second upper limit may be increased or decreased between the initial upper limit (first upper limit) and the lower limit. It is possible to further reduce power consumption by appropriately adjusting the second upper limit to an optimal value according to a state of the device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device comprising:

a fixing unit configured to fix an image on a sheet with heat when the sheet passes through a nip formed in the fixing unit;

a temperature detection unit disposed adjacent to the fixing unit; and a control unit configured to change a maximum amount of power that is suppliable to the fixing unit from a first value to a second value that is smaller than the first value, based on a temperature detected by the temperature detection unit, wherein the control unit changes the maximum amount of power from the first value to the second value when the temperature detection unit detects at least one local maximum temperature and at least one local minimum temperature that fit within a predetermined temperature range.

2. The fixing device according to claim 1, wherein the control unit further decreases the maximum amount of power from the second value by a predetermined value when the temperature detection unit detects a predetermined number of local maximum temperatures and a predetermined number of local minimum temperatures that fit within the predetermined temperature range.

3. The fixing device according to claim 1, wherein the control unit changes the maximum amount of power from the first value to the second value when a predetermined time period has passed after the supply of power to the fixing unit has started.

4. The fixing device according to claim 1, wherein the control unit is further configured to change an amount of power that is supplied to the fixing unit to a third value that is smaller than the second value and greater than zero, when the detected temperature increases to a predetermined threshold value.

5. The fixing device according to claim 4, wherein the third value is greater than ½ of the first value.

6. The fixing device according to claim 4, wherein the control unit is further configured to change the amount of supplied power to zero, when the detected temperature further increases to an another threshold value that is greater than the predetermined threshold value.

7. The fixing device according to claim 1, wherein the control unit is further configured to decrease the amount of supplied power by a predetermined value every predetermined time period during which the detected temperature increases and is within the predetermined temperature range.

8. The fixing device according to claim 1, wherein the control unit is further configured to increase the amount of supplied power by a predetermined value every predetermined time period during which the detected temperature decreases and is within the predetermined temperature range.

9. The fixing device according to claim 1, wherein the control unit is further configured to decrease the amount of supplied power by a predetermined value every predetermined time period during which the detected temperature is within the predetermined temperature range and greater than a target temperature that is within the predetermined temperature range.

10. The fixing device according to claim 1, wherein the control unit is further configured to increase the amount of supplied power by a predetermined value every predetermined time period during which the detected temperature is within the predetermined temperature range and smaller than a target temperature that is within the predetermined temperature range.

11. The fixing device according to claim 1, wherein the fixing unit includes an endless belt, a pressing member, the nip being formed between the endless belt and the pressing member, and an induction heating unit configured to heat the endless belt using an induction current.

12. An image forming apparatus comprising:

an image forming unit configured to form an image on a sheet;

a fixing unit configured to fix the image on the sheet with heat when the sheet passes through a nip formed in the fixing unit;

a temperature detection unit disposed adjacent to the fixing unit; and a control unit configured to change a maximum amount of power that is suppliable to the fixing unit from a first value to a second value that is smaller than the first value, based on a temperature detected by the temperature detection unit, wherein the control unit changes the maximum amount of power from the first value to the second value when the temperature detection unit detects at least one local maximum temperature and at least one local minimum temperature that fit within a predetermined temperature range.

13. The image forming apparatus according to claim 12, wherein the control unit is further configured to change an amount of power that is supplied to the fixing unit to a third value that is smaller than the second value and greater than zero, when the detected temperature increases to a predetermined threshold value.

14. The image forming apparatus according to claim 12, wherein the control unit is further configured to decrease the amount of supplied power by a predetermined value every predetermined time period, when the detected temperature increases and within the predetermined temperature range.

15. The image forming apparatus according to claim 12, wherein the control unit is further configured to increase the amount of supplied power by a predetermined value every predetermined time period during which the detected temperature decreases and is within the predetermined temperature range.

16. A fixing device comprising:

a fixing unit configured to fix an image on a sheet with heat when the sheet passes through a nip formed in the fixing unit;

a temperature detection unit disposed adjacent to the fixing unit; and a control unit configured to change an amount of power that is supplied to the fixing unit from a first value to a second value that is smaller than the first value and greater than zero, based on a temperature detected by the temperature detection unit, wherein the control unit decreases the amount of supplied power from the first value by a predetermined value every predetermined time period when the detected temperature increases to a threshold value.

17. The fixing device according to claim 16, wherein the control unit increases the amount of supplied power from the second value by a predetermined value every predetermined time period when the detected temperature decreases to a threshold value.

* * * * *